US011642563B2

(12) United States Patent
Weng

(10) Patent No.: US 11,642,563 B2
(45) Date of Patent: May 9, 2023

(54) ADJUSTABLE DUMBBELL

(71) Applicant: Zhenyu Weng, Yongkang (CN)

(72) Inventor: Zhenyu Weng, Yongkang (CN)

( * ) Notice: Subject to any disclaimer, the term of this patent is extended or adjusted under 35 U.S.C. 154(b) by 189 days.

(21) Appl. No.: 17/232,189

(22) Filed: Apr. 16, 2021

(65) Prior Publication Data

US 2022/0047908 A1 Feb. 17, 2022

(30) Foreign Application Priority Data

Aug. 13, 2020 (CN) ..... 202021678825.6

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/075; A63B 21/0726; A63B 21/0728; A63B 21/072–075; A63B 21/0004; A63B 21/06; A63B 21/00; A63B 21/00058–00065; A63B 21/062; A63B 21/076–0783; A63B 21/4023; A63B 21/4033; A63B 21/4035
See application file for complete search history.

(56) References Cited

U.S. PATENT DOCUMENTS

| | | | | |
|---|---|---|---|---|
| 7,261,678 | B2 * | 8/2007 | Crawford | A63B 71/0054 482/94 |
| 8,025,613 | B1 * | 9/2011 | Wang | A63B 21/075 482/107 |
| 2017/0239510 | A1 * | 8/2017 | Wang | A63B 21/0724 |
| 2018/0169459 | A1 * | 6/2018 | Wang | A63B 21/4035 |
| 2018/0353794 | A1 * | 12/2018 | Wang | A63B 71/0036 |
| 2020/0330813 | A1 * | 10/2020 | Liu | A63B 21/0722 |
| 2022/0176186 | A1 * | 6/2022 | Chen | A63B 21/075 |
| 2022/0347512 | A1 * | 11/2022 | Hong | A63B 21/075 |

* cited by examiner

*Primary Examiner* — Joshua Lee
*Assistant Examiner* — Catrina A Letterman
(74) *Attorney, Agent, or Firm* — Bayramoglu Law Offices LLC

(57) ABSTRACT

An adjustable dumbbell includes a base, a grip, and a plurality of sets of dumbbell plate assemblies connected on both sides of the grip. The dumbbell plate assembly includes a rotating member, an adapter, a limiting member and a weight plate. The rotating member rotates with the grip. The limiting member is located between the rotating member and the adapter. The limiting member fits with and is connected to the adapter in a non-rotatable manner. When the rotating member rotates, the rotating member abuts against the abutting rib to drive the limiting member to translate, so that the protrusion is inserted into or separated from the insertion hole to connect or separate the limiting member and the adapter.

10 Claims, 5 Drawing Sheets

ADJUSTABLE DUMBBELL

CROSS REFERENCE TO THE RELATED APPLICATIONS

This application is based upon and claims priority to Chinese Patent Application No. CN 202021678825.6, filed on Aug. 13, 2020, the entire contents of which are incorporated herein by reference.

TECHNICAL FIELD

The present invention belongs to the field of exercise equipment, and more particularly, to an adjustable dumbbell.

BACKGROUND

Dumbbells have been designed to be weight adjustable in order to suit different user groups. In this case, the weight plates placed on the base are mounted on the grip as needed. At present, however, the disassembly and assembly for the weight plates of adjustable dumbbells available on the market entail cumbersome operations.

SUMMARY

In order to overcome the shortcomings of the prior art, the present invention provides a dumbbell with a simple disassembly operation and a secure structure.

In order to solve the technical problems, the present invention adopts the following technical solution. An adjustable dumbbell includes a base, a grip, and a plurality of sets of dumbbell plate assemblies connected on both sides of the grip. The dumbbell plate assembly includes a rotating member, an adapter, a limiting member and a weight plate. The rotating member is configured to rotate with the grip. The limiting member is located between the rotating member and the adapter. The limiting member fits with and is connected to the adapter in a non-rotatable manner. The adapters of the plurality of sets of dumbbell plate assemblies are connected by a connecting block. One side of the limiting member facing the rotating member is provided with abutting ribs, and the other side of the limiting member facing the adapter is provided with a protrusion. An insertion hole is formed at a position of the adapter corresponding to the protrusion. The limiting member and the adapter are elastically connected. When the rotating member rotates, the rotating member abuts against the abutting ribs to drive the limiting member to translate, so that the protrusion is inserted into or separated from the insertion hole to connect or separate the limiting member and the adapter.

In the present invention, different numbers of dumbbell plate assemblies can be chosen and used flexibly to meet different needs of users. The plurality of sets of dumbbell plate assemblies are connected or separated only by rotating the grip, which is convenient to operate. Moreover, the structure for connecting the dumbbell plate assemblies to the grip is secure and effective, is not prone to separate, and thus has high safety performance.

Further, the abutting ribs on limiting members of the plurality of sets of dumbbell plate assemblies have different circumferential lengths decreasing from a position adjacent to the center of the grip to both sides of the grip.

Further, the number of the sets of dumbbell plate assemblies is four. When the grip is rotated in a circumferential direction through one complete rotation, the weight plate of each of the plurality of sets of dumbbell plate assemblies is connected to the adapter. The design is reasonable, and the grip is rotated through one complete rotation to connect or separate all the dumbbell plate assemblies, which satisfies the users' habits.

Further, a side of the adapter facing the limiting member is provided with a positioning column, and an elastic member is sleeved on the positioning column. A positioning hole is formed at a position of the limiting member corresponding to the positioning column. The positioning column passes through the positioning hole. The two ends of the elastic member abut against the adapter and the limiting member, respectively, so that the limiting member and the adapter are elastically connected. The limiting member and the adapter are elastically connected, so that when the weight plate needs to be separated, the limiting member will automatically move away from the adapter, which is convenient to operate.

Further, a side of the rotating member facing the limiting member is provided with grooves that are arranged symmetrically, and a set of driving protrusions are formed between the grooves adjacent to each other. An end portion of the abutting rib is provided with an inclined surface. The driving protrusions abut against and slide along the inclined surface. The inclined surface is designed to enable the driving protrusions to slide smoothly to the side of the abutting rib, which is more effort-saving to operate.

Further, the adjustable dumbbell further includes a locking mechanism. The locking mechanism includes a fixing member, a movable member capable of rotating with the grip, and a locking member. A plurality of through holes are formed in the movable member along a circumferential direction. At least one set of elastic balls are arranged on the fixing member. When the movable member and the fixing member rotate relative to each other, the elastic ball partially falls into the through hole. The edge of the movable member is provided with convex teeth arranged at intervals. The through holes and the convex teeth are alternately distributed. When the locking mechanism is separated from the base, the locking member moves to be engaged between adjacent convex teeth to prevent the movable member from rotating. The locking mechanism prevents the plurality of sets of dumbbell plate assemblies from loosening and slipping during use to improve safety.

Further, the number of the through holes is ten. Abutting ribs arranged on a dumbbell plate assembly far away from the center of the grip are two symmetrically arranged arc convex ribs with a central angle of 36°.

Further, a clamping slot is formed at a position of the weight plate corresponding to the insertion hole, and the protrusion is inserted into the clamping slot.

Further, the weight plate includes a body with a first U-shaped notch, and a thin-walled portion extending from the first U-shaped notch. The thin-walled portion is provided with a second U-shaped notch. The connecting block is transversely inserted between second U-shaped notches of a plurality of weight plates, and the adapter is longitudinally inserted into the first U-shaped notch. The first U-shaped notch limits the axial translation of the adapter, so as to ensure the stability of the overall structure.

Further, the connecting block is fixedly connected to the adapters of the plurality of sets of dumbbell plate assemblies, and one end of the connecting block is connected to the fixing member.

The present invention has the following advantages. It is simple and effort-saving to connect or separate the weight plates. The locking structure is secure and effective, so that the overall structure is secure and thus improves safety during use.

DETAILED DESCRIPTION OF THE EMBODIMENTS

In order to make those skilled in the art better understand the technical solution of the present invention, the technical solution in the embodiments of the present invention will be clearly and completely described below with reference to the drawings in the embodiments of the present invention. Obviously, the embodiments described are only part of the embodiments of the present invention, rather than all the embodiments. Based on the embodiments of the present invention, all other embodiments obtained by those having ordinary skill in the art without creative efforts shall fall within the scope of protection of the present invention.

As shown in FIGS. 1-9, an adjustable dumbbell includes the base 1, the grip 2, and a plurality of sets of dumbbell plate assemblies 3 connected on both sides of the grip 2. When the grip 2 is rotated, the number of dumbbell plate assemblies 3 connected to the grip 2 is adjusted.

Figure 1:
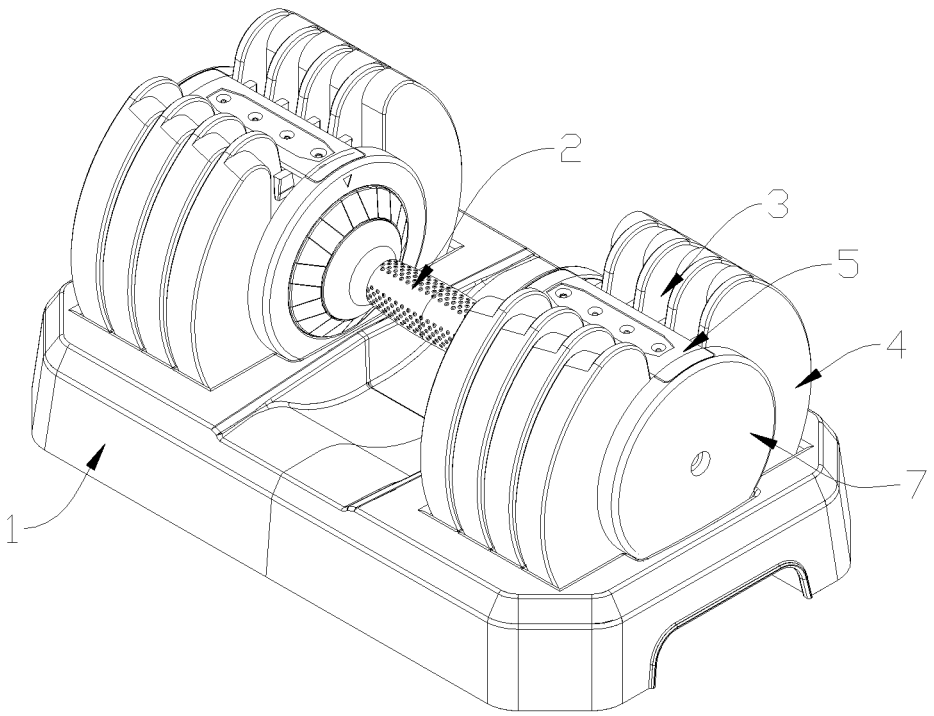
FIG. 1 is a perspective view of the present invention in an assembled state.
Figure 2:
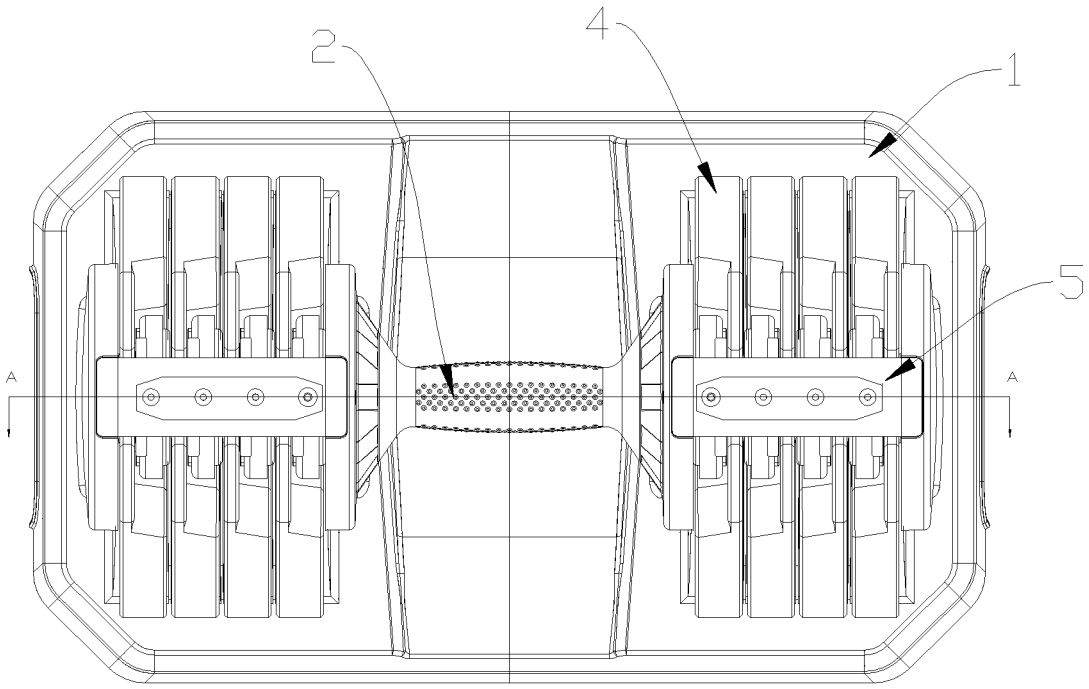
FIG. 2 is a top view of the present invention in the assembled state.
Figure 3:
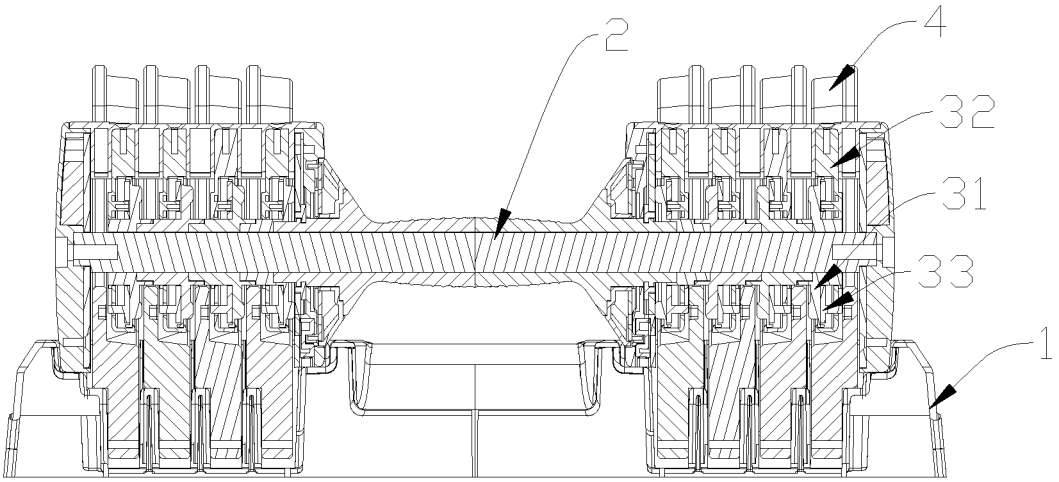
FIG. 3 is a cross-sectional view of the present invention in the assembled state.
Figure 4:
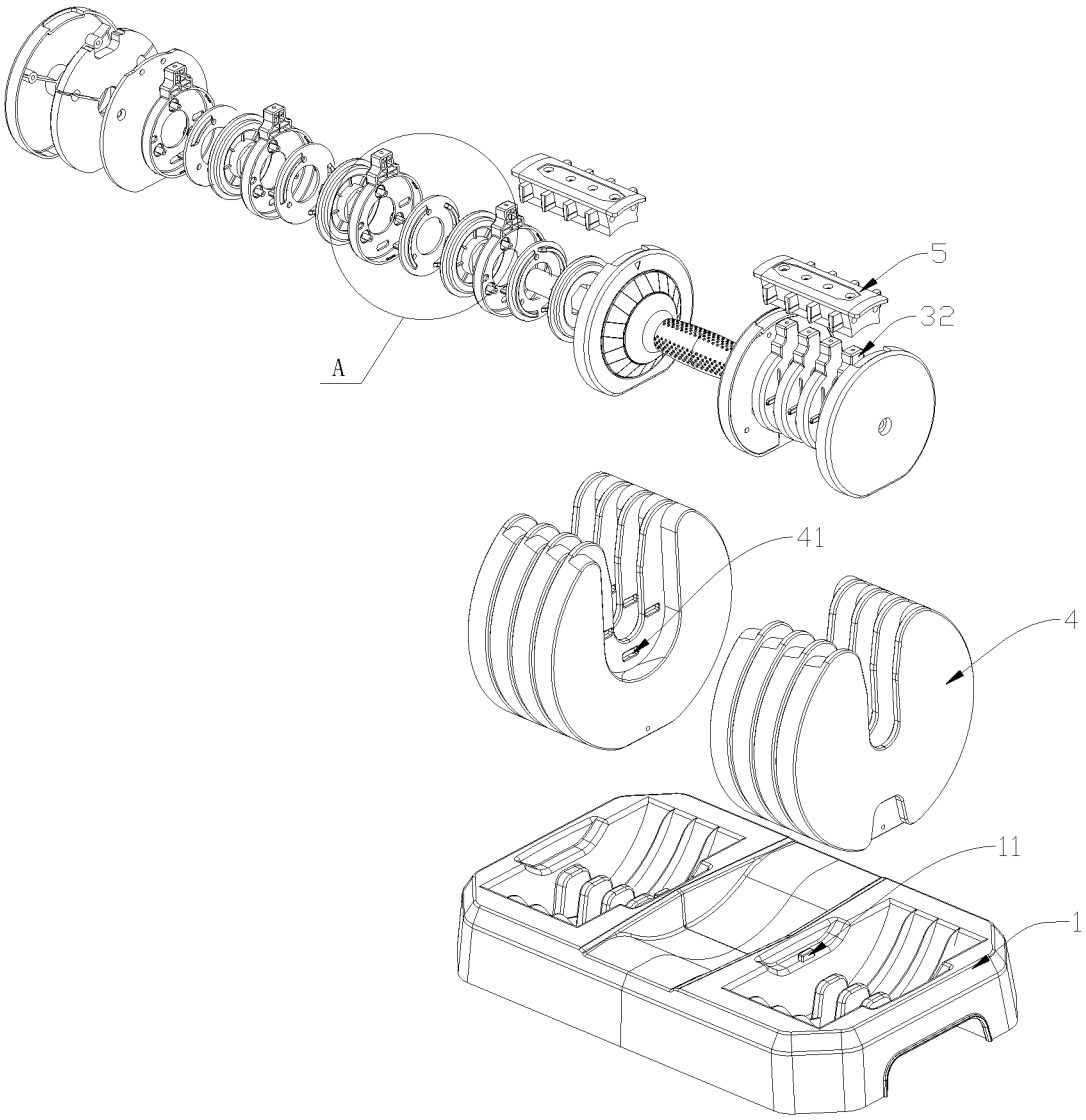
FIG. 4 is a first exploded view of the present invention.
Figure 5:
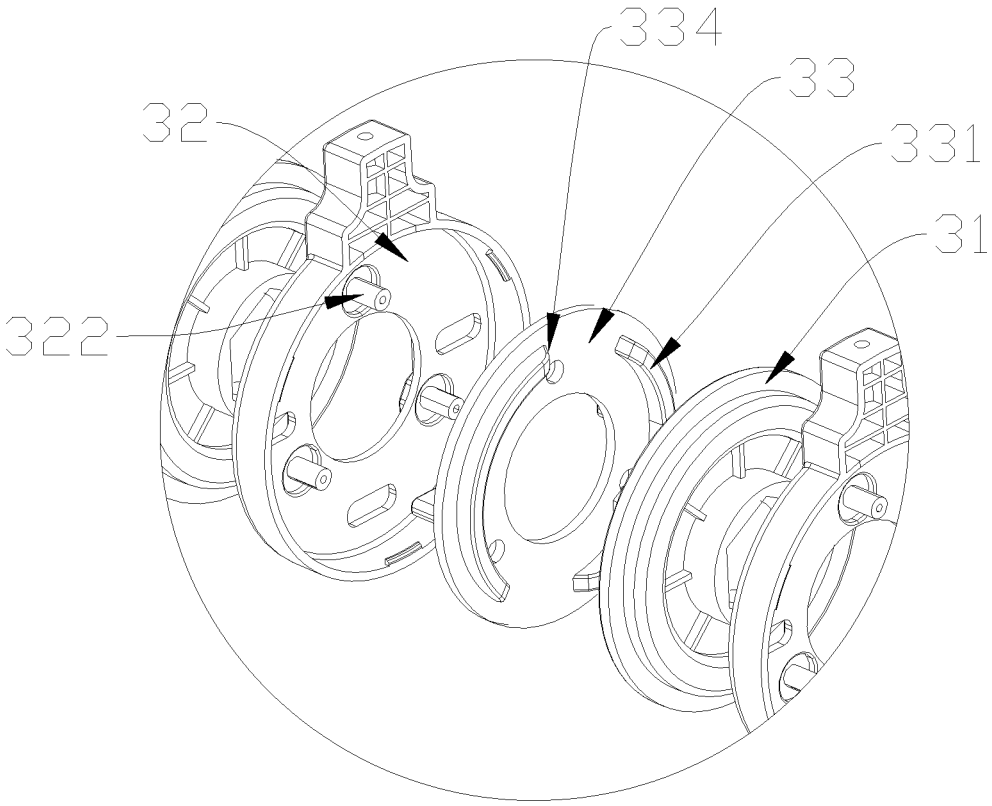
FIG. 5 is an enlarged view of the structure of the portion A circled in FIG. 4.
Figure 6:
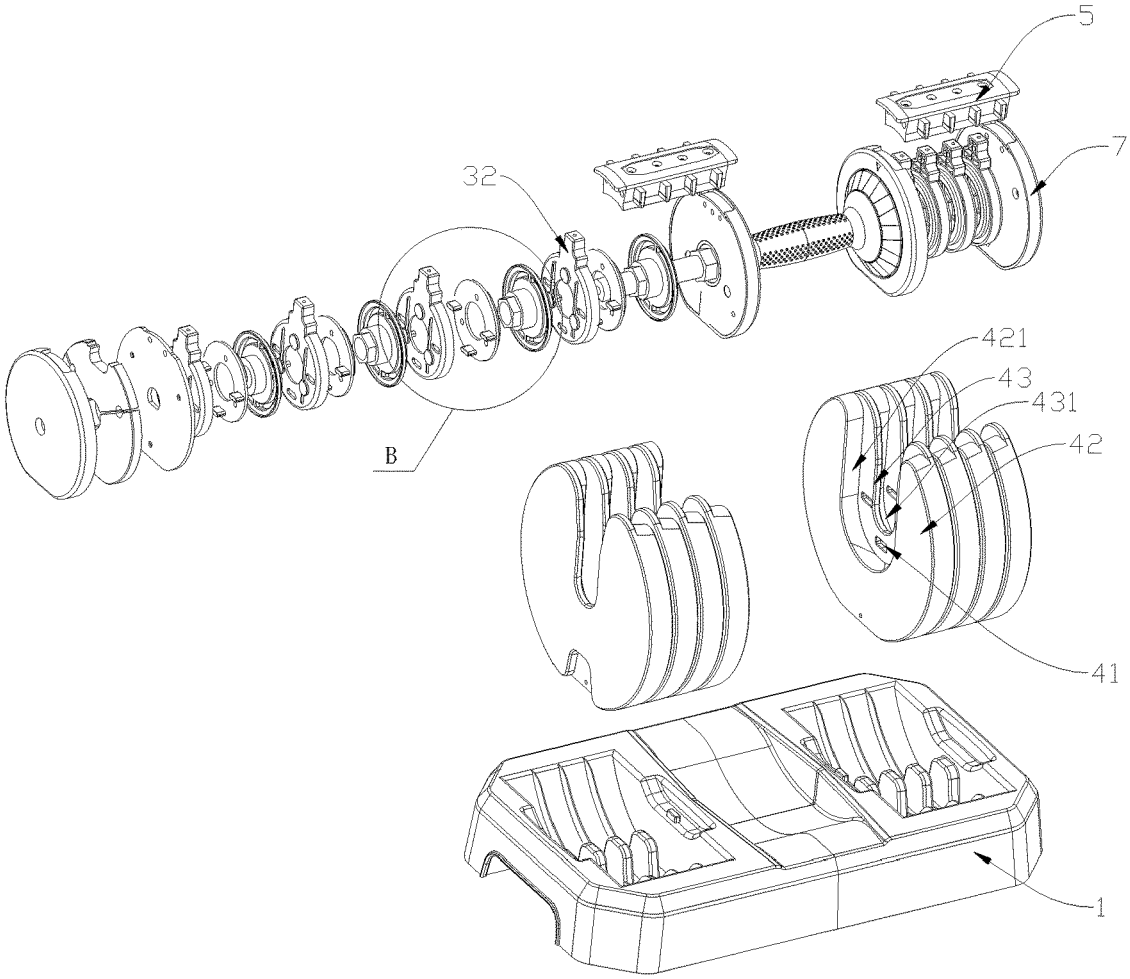
FIG. 6 is a second exploded view of the present invention.
Figure 7:
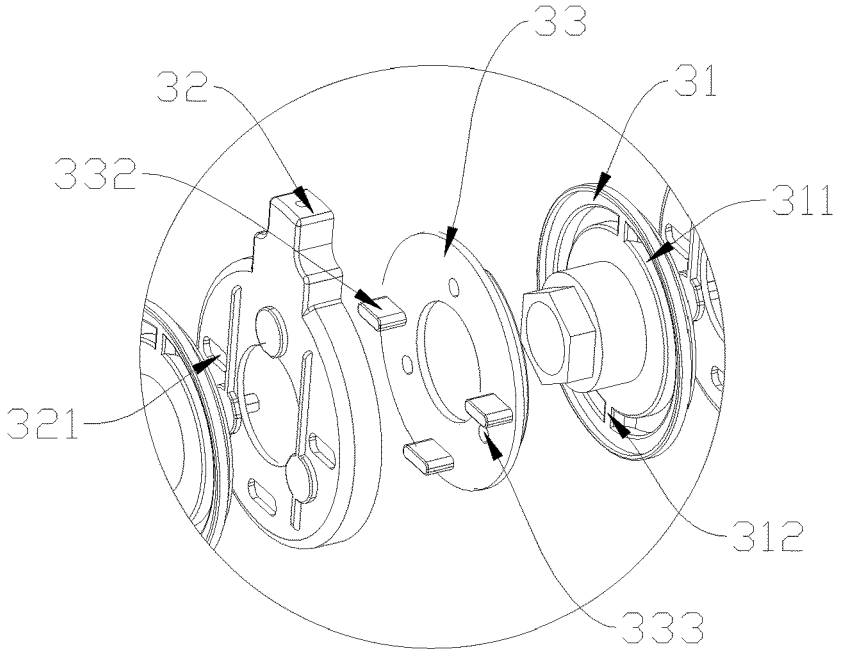
FIG. 7 is an enlarged view of the structure of the portion B circled in FIG. 6.

The dumbbell plate assembly 3 includes the rotating member 31, the adapter 32, the limiting member 33 and the weight plate 4. The rotating member 31 fits with and is connected to the grip 2 in a non-rotatable manner. The rotating member 31 can rotate synchronously with the grip 2. The limiting member 33 is located between the rotating member 31 and the adapter 32. The limiting member 33 fits with and is connected to the adapter 32 in a non-rotatable manner. As shown in FIGS. 5 and 7, one side of the limiting member 33 facing the rotating member 31 is provided with the abutting ribs 331, and the other side of the limiting member 33 facing the adapter 32 is provided with the protrusion 332. The insertion hole 321 is formed at a position of the adapter 32 corresponding to the protrusion 332. The shape and size of the insertion hole 321 are adapted to the shape and size of the protrusion 332.

The limiting member 33 and the adapter 32 are elastically connected. Specifically, a side of the adapter 32 facing the limiting member 33 is vertically provided with the positioning column 322, and an elastic member (not shown) is sleeved on the positioning column 322. The positioning hole 333 is formed at a position of the limiting member 33 corresponding to the positioning column 322. When the positioning column 322 passes through the positioning hole 333, one end of the elastic member abuts against the adapter 32, and the other end of the elastic member abuts against the limiting member 33, so that the limiting member 33 and the adapter 32 are elastically connected and fitted with each other in a non-rotatable manner.

When an external force is applied to rotate the rotating member 31, that is, in the present embodiment of the present invention, when the external force is applied to rotate the grip 2, the rotating member 31 rotates synchronously, and the rotating member 31 abuts against the abutting ribs 331 to drive the limiting member 33 to translate along the grip 2, so that the protrusion 332 is inserted into or separated from the insertion hole 321 to connect or separate the limiting member 33 and the adapter 32.

As shown in FIG. 7, a side of the rotating member 31 facing the limiting member 33 is provided with the grooves 311 that are arranged symmetrically. A set of driving protrusions 312 are formed between the grooves 311 adjacent to each other. The driving protrusions 312 can abut against the abutting ribs 331 to enable the limiting member 33 to translate. In order to enable the driving protrusion 312 to rotate to abut against a side of the abutting rib 331, the end portion of the abutting rib 331 is provided with the inclined surface 334, so that the driving protrusions 312 can slide along the inclined surface 334 until rotating to the side of the abutting rib 331.

The abutting ribs 331 on the limiting members 33 of the plurality of sets of dumbbell plate assemblies 3 have different circumferential lengths. Specifically, when the abutting ribs 331 are closer to the center of the grip 2, the abutting ribs 331 have greater circumferential lengths. When the abutting ribs 331 on the dumbbell plate assemblies 3 are far away from both sides of the center of the grip 2, the abutting ribs 331 have gradually decreased circumferential lengths. In the present embodiment, the abutting ribs 331 are arranged symmetrically in pairs. The outermost abutting ribs 331 are two arc convex ribs with a central angle of 36°. The number of the sets of dumbbell plate assemblies 3 is four. Along the direction toward the center of the grip 2, the abutting ribs 331 are a pair of arc convex ribs with a central angle of 72°, a pair of arc convex ribs with a central angle of 144°, a pair of arc convex ribs with a central angle of 216° or a pair of arc convex ribs with a central angle of 288°. Certainly, the specific value of the central angle is not limited thereto. Thus, when the grip 2 is rotated in the circumferential direction through one complete rotation, all four sets of dumbbell plate assemblies 3 are connected to the weight plates 4.

In order to prevent the adapter 32 from rotating in the circumferential direction, the adapters 32 of the plurality of sets of dumbbell plate assemblies 3 are fixedly connected by the connecting block 5.

Figure 8:
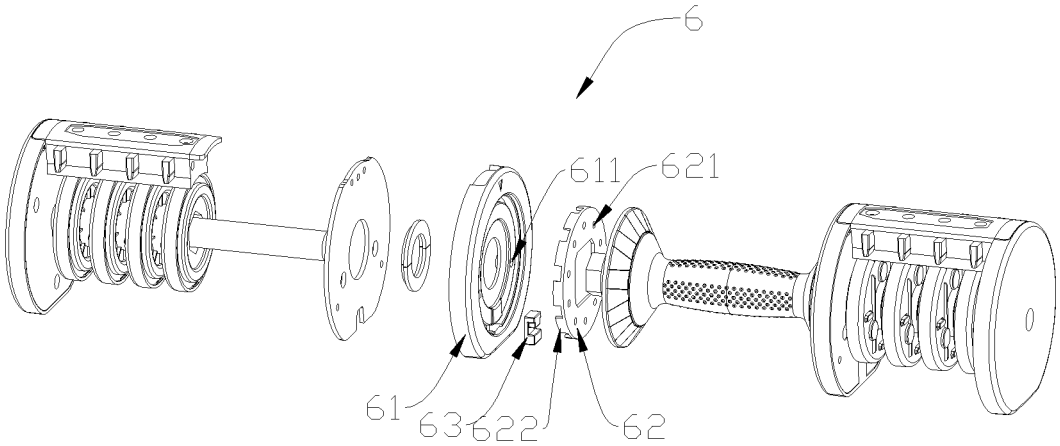
FIG. 8 is a first exploded view of the structure of a locking mechanism of the present invention.
Figure 9:
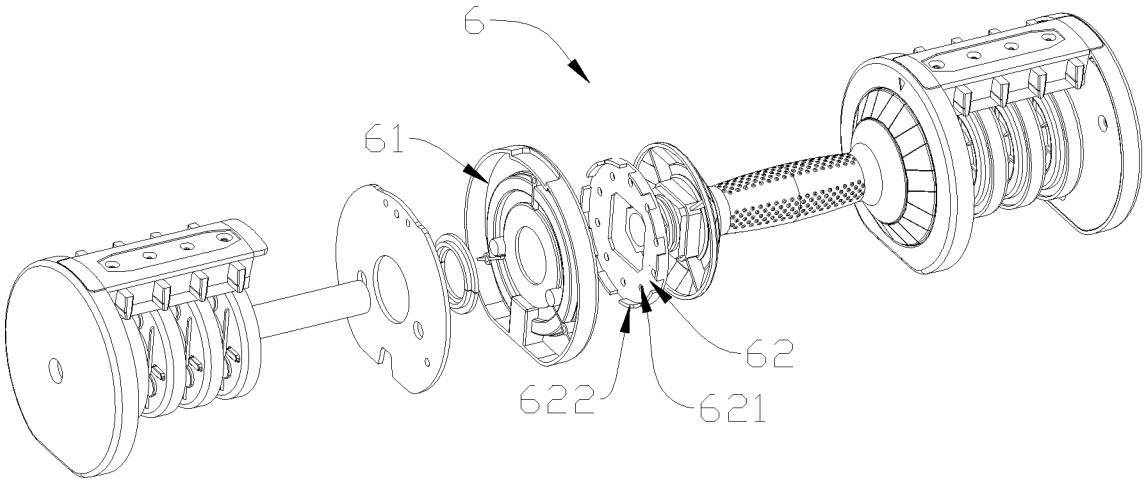
FIG. 9 is a second exploded view of the structure of the locking mechanism of the present invention.

The dumbbell further includes the locking mechanism 6. As shown in FIGS. 8 and 9, the locking mechanism 6 includes the fixing member (a plate) 61 sleeved on the grip 2, the movable member 62 capable of rotating synchronously with the grip 2, and the locking member (a bracket) 63. A plurality of through holes 621 are formed in the movable member 62 along the circumferential direction. At least one set of elastic balls 611 are arranged on the fixing member 61. When the movable member 62 and the fixing member 61 rotate relative to each other, the elastic ball 611 partially falls into the through hole 621 to limit the position of the fixed member 61 and the movable member 62, such that the fixed member 61 and the movable member 62 are fitted with each other in a non-rotatable manner. In the present embodiment, one end of the elastic ball 611 is connected to a spring, and the spring extends into the fixing member 61. The number of one set of elastic balls 611 is two, and the number of the through holes 621 is ten, so that the through holes 621 and the elastic balls 611 are engaged in five movement path modes. One of the five movement path modes serves as an initial state, and the other four movement path modes are configured to connect four weight plates 4, respectively.

The edge of the movable member 62 is bent to form the convex teeth 622. A gap is formed between the adjacent convex teeth 622. The through holes 621 and the convex teeth 622 are alternately distributed, that is, the through hole 621 and the gap are arranged directly opposite to each other.

The locking member 63 is movably connected to the fixing member 61. In the initial state, that is, when the dumbbell plate assembly 3 is placed on the base 1, the locking member 63 is pushed upward by the unlocking block 11 on the base 1, so that the locking member 63 is not engaged into the gap between the convex teeth 622, and the movable member 62 can rotate freely at this time. When the locking mechanism 6 and the dumbbell plate assembly 3 are separated from the base 1, the locking member 63 moves downward to be engaged into the gap between the convex teeth 622, so as to prevent the movable member 62 from rotating, thereby preventing the grip 2 from rotating in the circumferential direction.

When the movable member 62 rotates in the circumferential direction until the elastic ball 611 falls into the through hole 621, one set of dumbbell plate assemblies 3 are connected to the weight plate 4 to supply a sensation to the hand of the user.

The clamping slot 41 is formed at a position of the weight plate 4 corresponding to the insertion hole 321. The protrusion 332 passes through the adapter 32 and is then inserted into the clamping slot 41. The size and shape of the clamping slot 41 are adapted to the size and shape of the protrusion 332.

A notch is formed at the top of the weight plate 4. The weight plate 4 includes the body 42 with the first U-shaped notch 421 and the thin-walled portion 43 extending from the first U-shaped notch 421. The thin-walled portion 43 is provided with the second U-shaped notch 431. In this arrangement, the connecting block 5 is inserted between the second U-shaped notches 431 of the plurality of weight plates 4. The connecting block 5 is fixedly connected to the adapters 32 of the plurality of sets of dumbbell plate assemblies 3. One end of the connecting block 5 is fixedly connected to the fixing member 61, and the other end of the connecting block 5 is fixedly connected to the limit disc 7 on the outer side of the dumbbell. The adapter 32 is inserted into the first U-shaped notch 421, so that the first U-shaped notch 421 limits the position of the adapter 32.

In use, the plurality of sets of dumbbell plate assemblies 3 are placed on the base 1, and the grip 2 is rotated, so that the weight plates 4 of one set of dumbbell plate assemblies 3 adjacent to the center of the grip 2 are connected to the grip 2. Specifically, the rotating member 31 is rotated to enable the driving protrusion 312 to slide along the inclined surface 334 to the side of the abutting rib 331, so that the limiting member 33 translates in the direction away from the rotating member 31, and then the protrusion 332 on the limiting member 33 is inserted into the insertion hole 321 of the adapter 32 to be inserted into the clamping slot 41 of the weight plate 4, so as to connect the weight plate 4. The grip 2 continues to be rotated, so that the weight plates 4 of the second set of dumbbell plate assemblies 3 of the grip are connected to the grip 2. Different numbers of weight plates 4 are connected as needed, or all the weight plates 4 are connected to the grip 2.

When the weight plate 4 needs to be removed, it is only necessary to reversely rotate the grip 2. In this case, under the action of the elastic member, the limiting member 33 moves away from the adapter 32, and the protrusion 332 is separated from the insertion hole 321.

The above specific embodiments are used to explain the present invention, rather than to limit the present invention. Any modifications and changes made to the present invention within the spirit and the scope of protection of the claims of the present invention shall fall within the scope of protection of the present invention.

What is claimed is:

1. An adjustable dumbbell, comprising a base, a grip, and a plurality of sets of dumbbell plate assemblies connected on each side of the grip; wherein each dumbbell plate assembly of the plurality of sets of dumbbell plate assemblies comprises a rotating member, an adapter, a limiting member and a weight plate; wherein the rotating member is configured to rotate with the grip;

the limiting member is located between the rotating member and the adapter; and the limiting member fits with and is connected to the adapter in a non-rotatable manner; wherein each of the adapters of the plurality of sets of dumbbell plate assemblies on each respective side of the grip are connected by a connecting block;

a first side of the limiting member faces the rotating member, and the first side of the limiting member is provided with abutting ribs;

a second side of the limiting member faces the adapter, and the second side of the limiting member is provided with a protrusion;

an insertion hole is formed at a position of the adapter corresponding to the protrusion;

the limiting member and the adapter are elastically connected;

when the rotating member rotates, the rotating member abuts against the abutting ribs to drive the limiting member to translate, and the protrusion is inserted into or separated from the insertion hole to connect or separate the limiting member and the adapter.

2. The adjustable dumbbell of claim 1, wherein the abutting ribs on limiting members of each of the plurality of sets of dumbbell plate assemblies have different circumferential lengths decreasing from a position adjacent to a center of the grip to the both sides of the grip.

3. The adjustable dumbbell of claim 1, wherein a number of the sets of dumbbell plate assemblies is four;

when the grip is rotated in a circumferential direction through one complete rotation, the weight plate of the each dumbbell plate assembly of the plurality of sets of dumbbell plate assemblies is connected to the respective adapter.

4. The adjustable dumbbell of claim 1, wherein a side of the adapter faces the limiting member, and the side of the adapter is provided with a positioning column;

a positioning hole is formed at a position of the limiting member corresponding to the positioning column; and the positioning column passes through the positioning hole, and the limiting member and the adapter are connected.

5. The adjustable dumbbell of claim 1, wherein a side of the rotating member faces the limiting member, and the side of the rotating member is provided with grooves arranged symmetrically;

a set of driving protrusions are formed between the grooves adjacent to each other; and an end portion of the abutting rib is provided with an inclined surface, and the set of driving protrusions abut against and slide along the inclined surface.

6. The adjustable dumbbell of claim 1, further comprising a locking mechanism; wherein the locking mechanism comprises a fixing member, a movable member, and a locking member, wherein the movable member rotates with the grip;

a plurality of through holes are formed in the movable member along a circumferential direction;

at least one set of elastic balls are arranged on the fixing member;

when the movable member and the fixing member rotate relative to each other, an elastic ball of the at least one set of the elastic balls partially falls into a through hole of the plurality of through holes;

an edge of the movable member is provided with convex teeth arranged at intervals, and the plurality of through holes and the convex teeth are alternately distributed;

when the locking mechanism is separated from the base, the locking member moves to be engaged between adjacent convex teeth to prevent the movable member from rotating.

7. The adjustable dumbbell of claim 6, wherein a number of the plurality of through holes is ten, the abutting ribs on a dumbbell plate assembly far away from the center of the grip are two symmetrically arranged arc convex ribs.

8. The adjustable dumbbell of claim 1, wherein a clamping slot is formed at a position of the weight plate corresponding to the insertion hole, and the protrusion is inserted into the clamping slot.

9. The adjustable dumbbell of claim 6, wherein the weight plate comprises a body with a first U-shaped notch and a thin-walled portion extending from the first U-shaped notch;

the thin-walled portion is provided with a second U-shaped notch;

the connecting block is transversely inserted between second U-shaped notches of weight plates of the plurality of sets of dumbbell plate assemblies, and the corresponding adapter is longitudinally inserted into the first U-shaped notch.

10. The adjustable dumbbell of claim 9, wherein the connecting block is fixedly connected to the adapters of the plurality of sets of dumbbell plate assemblies, and one end of the connecting block is connected to the fixing member.

* * * * *